US007326317B2

(12) United States Patent
Westermark et al.

(10) Patent No.: US 7,326,317 B2
(45) Date of Patent: Feb. 5, 2008

(54) LIGNOCELLULOSE PRODUCT

(76) Inventors: Ulla Westermark, Hörnåkersvägen 45, SE-183 65 Täby (SE); Olov Karlsson, Orkestervägen 60, SE-931 46 Skelleftea (SE)

( * ) Notice: Subject to any disclaimer, the term of this patent is extended or adjusted under 35 U.S.C. 154(b) by 0 days.

(21) Appl. No.: 10/494,469

(22) PCT Filed: Oct. 31, 2002

(86) PCT No.: PCT/EP02/12130

§ 371 (c)(1),
(2), (4) Date: Sep. 14, 2004

(87) PCT Pub. No.: WO03/042451

PCT Pub. Date: May 22, 2003

(65) Prior Publication Data

US 2005/0011621 A1 Jan. 20, 2005

Related U.S. Application Data

(60) Provisional application No. 60/330,849, filed on Nov. 1, 2001.

(30) Foreign Application Priority Data

Nov. 1, 2001 (EP) ..... 01850186

(51) Int. Cl.
*D21C 9/00* (2006.01)
*D21J 3/00* (2006.01)

(52) U.S. Cl. ..... 162/13; 162/78; 162/150; 162/181.3; 162/224

(58) Field of Classification Search ..... 162/13.78, 162/150, 181.3, 224
See application file for complete search history.

(56) References Cited

U.S. PATENT DOCUMENTS

| | | | | | |
|---|---|---|---|---|---|
| 2,388,487 | A | * | 11/1945 | Linzell | 162/181.3 |
| 3,686,383 | A | * | 8/1972 | Makinen | 264/120 |
| 3,900,334 | A | * | 8/1975 | Brink | 106/165.01 |
| 4,007,312 | A | | 2/1977 | Stofko et al. | |
| 4,022,965 | A | | 5/1977 | Goheen et al. | |
| 4,409,170 | A | * | 10/1983 | Stofko | 264/113 |
| 4,454,005 | A | | 6/1984 | Stofko et al. | |
| 4,496,718 | A | * | 1/1985 | Rudy | 536/56 |
| 5,021,122 | A | * | 6/1991 | Desrochers et al. | 162/150 |
| 5,846,788 | A | * | 12/1998 | Pedersen et al. | 435/101 |
| 6,245,269 | B1 | * | 6/2001 | Viikari et al. | 264/109 |

FOREIGN PATENT DOCUMENTS

EP 1 106 732 6/2001

* cited by examiner

*Primary Examiner*—Steven P. Griffin
*Assistant Examiner*—Dennis R. Cordray
(74) *Attorney, Agent, or Firm*—Young & Thompson

(57) ABSTRACT

The invention concerns a process for the production of activated fibres or particles having self-binding properties comprising the steps of treating fibers or particles of lignocellulose containing material by contacting them with an oxidant during a time sufficient for the formation of water soluble reaction products with binding properties and retaining at least a significant part of said water soluble reaction products with the treated fibers or particles. The invention further concerns activated fibers or particles obtainable by the process, a press molded product and a process for the production thereof from activated fibers or particles.

18 Claims, No Drawings

LIGNOCELLULOSE PRODUCT

The present invention relates to activated fibres or particles of lignocellulose containing material and a process for the production thereof. It further relates to a press moulded product and a process for the production thereof from activated fibres or particles.

Press moulded products such as board of lignocellulose based materials is generally made by pressing moulding fibres or particles of a lignocellulose containing material together with a binding system such as phenol/formaldehyde, urea/formaldehyde, melamine/urea/formaldehyde or isocyanate. A common problem with these binding systems is the liberation of volatile and toxic substances during production and/or use of the product.

There have been some attempts to overcome this problem by treating the lignocellulose containing material with an oxidant to in situ generate a binder, but no such method has yet been commercialised.

U.S. Pat. No. 4,007,312 discloses that plywood or particle board can be made by adding an oxidant to a lignocellulosic material followed by pressing the material in an unsealed press to effect an oxidative coupling reaction essentially in the press. Since an unsealed press is used, significant amounts of water and water soluble substances will leave the material during the pressing.

U.S. Pat. No. 4,022,965 discloses a process comprising treating lignocellulosic fibres with an oxidant in the presence of sulphuric acid, removing residual chemical reagent by washing in a hydration and a dewatering step and then forming a sheet from the treated fibres.

U.S. Pat. No. 4,454,005 discloses a process for producing paper and board by treating a wet preformed sheet of a lignocellulosic fibre material and making oxidation and oxidative coupling reaction essentially under the pressing operation. Pressing of the treated sheet is preferentially done in a papermachine between two sieve screens. A process for making hardboard (masonite) is also disclosed wherein lignocellulosic material is heated with sodium nitrate or sodium chlorate under pressure at high temperature (>220° C.). Sodium nitrate or sodium chlorate is not generally known to be radical species.

EP 1 106 732 A2 discloses a process for production of aldehyde modified cellulose pulp by oxidation with nitroxyl radicals. The disclosed process is limited to cellulosic material and papermaking conditions were water is removed from the press. The nitroxyl radical in the disclosed process serves as a primary oxidant for the cellulose oxidation and a secondary oxidant is required for the regeneration of the nitroxylradical system. This system can consist of oxidation agents as sodium hypochlorite or hydrogen peroxide/iron. It is the object of the present innovation to use the oxidation agents directly on the lignocellulose material without addition of nitroxyl radicals.

It is an object of the present invention to provide lignocellulose containing fibres or particles with improved self-binding properties, which can be used for producing press moulded products without the need for adding binders emitting volatile and/or toxic substances like formaldehyde or isocyanate.

It is another object of the invention to provide an improved press moulded product from such lignocellulose containing fibres or particles.

It has surprisingly been found that when lignocellulose containing fibres or particles are treated with an oxidant, water soluble reaction products with excellent binding properties are formed. If such reaction products are retained with the treated fibres or particles they can be press moulded to form a product with improved properties.

The invention thus concerns a process for the production of activated fibres or particles having self-binding properties comprising the steps of treating fibres or particles of lignocellulose containing material by contacting them with an oxidant during a time sufficient for the formation of water soluble reaction products with binding properties and retaining at least a significant part of said water soluble reaction products with the treated fibres or particles.

The invention further concerns activated fibres or particles obtainable by such a process.

Lignocellulose refers to a mixture of compounds including as major components lignin, cellulose and hemicellulose. The fibres or particles of lignocellulose containing material may come from any suitable biological fibrous material such as wood or fibrous plants. Most kinds of wood can be used, hardwood as well as softwood, preferably having a density from about 350 to about 1000 kg/m$^3$. Examples of useful wood include spruce, pine, hemlock, fir, birch, aspen, red maple, poplar, alder, salix, cottonwood, rubber tree, marantii, eucalyptus, sugi and acase. Examples of fibrous plants include corn stalks, flax, hemp, cannabis, sisal hemp, bagasse, straw, cereal straws, reed, bamboo, mischantus, kenaf, canary reed, *Phalaris arundinacea* and other kinds of grass. Also other lignocellulose containing materials may be used such as pulp or recycling paper.

The fibres or particles may be in various physical form, from close to equidimensional to elongate and even sheet like. Examples of fibres or particles include saw-dust, wood shavings, cutter shavings, chips, strands, flakes, wafers, veneer, etc. Fibers from the lignocellulosic material can be obtained from any defibration method. Elongate or substantially equidimensional fibres or particles are particularly preferred. The average diameter of the fibres or particles is suitably from about 1 μm to about 10 mm, preferably from about 5 μm to about 5 mm. In the case of particles, the average diameter is most preferably from about 0.1 mm to about 3 mm. The average diameter refers to the average value of the shortest dimension of the fibres or particles. In the case of elongate fibres or particles this diameter corresponds to the thickness, while the length of such elongate fibres or particles may be up to several meters, preferably up to about 500 mm, most preferably up to about 200 mm. In the case of veneer or other sheet like particles this also applies to the width. The invention is particularly advantageous if the fibres or particles in no dimension exceeds an average value of about 200 mm, preferably about 150 mm, most preferably about 50 mm.

The moisture content of the fibres or particles may be within a wide range, for example with a weight ratio water to lignocellulose from about 0.01:1 to about 20:1, preferably from about 0.05:1 to about 1:1. Both fresh and dried material can be used and in some cases it may also be favourable to use fibres or particles that have been washed or leached with an aqueous medium such as water.

The fibres or particles of the material should preferably be separated to facilitate a homogenous contact with the oxidant.

A wide range of oxidants may be used, of which radical generating oxidants are preferred. Examples of such oxidants include inorganic or organic peroxy compounds, ozone, ozonides like dimethyloxiran, halogen (e.g. chlorine or bromine) containing oxidants, oxygen but preferentially non nitrogen containing oxidants. Thus, it is preferred that the oxidant is not a nitrate or nitroxylradical. Also, it is preferred not to use chlorate. Inorganic peroxy compounds are particularly preferred and may, for example, be selected from hydrogen peroxide or hydrogen peroxide generating compounds like alkali metal salts of percarbonate, perborate, peroxysulfate, peroxyphosphate or peroxysilicate, or corresponding weak acids. Useful organic peroxy compounds include peroxy carboxylic acids like peracetic acid or perbenzoic acid. Useful halogen containing oxidants include alkali metal chlorite, alkali metal hypochlorite, chlorine dioxide and chloro sodium salt of cyanuric acid. It is also possible to use combinations of different oxidants. The oxidant is preferably added to the fibres or particles together with a solvent like water, alcohol or any other suitable inorganic or organic solvent. The most preferred combination is an aqueous solution of hydrogen peroxide, suitably of a concentration from about 1 to about 90 wt %.

The total amount of oxidants use suitably from about 1 to about 100 wt %, preferably from about 4 to about 20 wt % of the lignocellulose in the fibres or particles. High amounts of oxidant increases the amount of water soluble reaction products and thereby also the binding properties of the treated fibres or particles, but an upper limit is set by the economy. By varying the amount of oxidant it is possible to select an optimal combination of the quality and price of the treated fibres or particles, depending on the intended use of the fibres or particles and the price of the oxidant.

The formation of the desired reaction products with binding properties is generally facilitated if the fibres or particles of lignocellulose containing material is contacted with the oxidant in the presence of a catalyst or initiator, which can be added to the fibres or particles before, after or simultaneously with the oxidant, for example in the form of an aqueous solution. Examples of useful catalysts include metal ions of, for example, iron, copper, manganese, tungsten and molybdenum, of which iron (e.g. $Fe^{2+}$ or $Fe^{3+}$) is particularly preferred. The metal ions may be used in the form of salts or complexes with common complexing agents such as EDTA, DTPA, phosphates or complexing agents based on phosphonic acid, oxalic acid, ascorbic acid, nitrilo acetate, gallic acid, fulvic acid or polyoxomethalates. Other catalysts or initiators include TAED, cyanamide and UV light. It is also possible to use combinations of different catalysts. The suitable amount of catalyst depends on the oxidant and the catalyst but is in most cases suitably from about 0.0001 to about 20 wt %, preferably from about 0.01 to about 5 wt % of the oxidant. In the case of iron ions and hydrogen peroxide the suitable amount of Fe is preferably from about 0.001 to about 10 wt %, most preferably from about 0.05 to about 5 wt % of the hydrogen peroxide. However, for some oxidants, such as peroxy carboxylic acids, the presence of a catalyst may not lead to any significant improvement.

As an alternative or a complement to an added oxidant it is also possible to use ultrasonic sound or photo- or electro Fenton reactions (in situ generation of hydroxyl radicals by radiation or electric currents).

The formation of reaction products with binding properties may also be enhanced by, before or during the step of contacting the fibres or particles with the oxidant, adding one or more substances containing phenolic, quinonic or other aromatic groups, for example in an amount from about 0.1 to about 20 wt %, preferably from about 1 to about 10 wt % of the lignocellulose. Examples of such substances include tannins, which are particularly preferred, and aromatic compounds like resorcinol, phenol, xylene and cresol. Other examples include lignin containing water, such as process water and liquors from the production of pulp, paper or board, or water from bark deposits or bark presses. Similar effect may be obtained with amines preferentially with amines containing conjugated double bonds. To take full advantage of the addition of the above substances it may be advisable to increase the amount of oxidant with about the same relative amount as the addition of said substance compared to the lignocellulose in the fibres or particles.

Furthermore the swelling and strength properties of a product is improves by high ionic strength in the process. This can be achieved by addition of salts. Addition of salts for example of 1-30% preferentially 2-10% decreases the swelling and increases the IB of boards manufactured by the process. The salt can be added either before, under or after oxidation. As with ionic strength the effect is enhanced by adding trivalent cations ions>divalent ions>>monovalent ions. This means that many salts can serve this purpose. Salts containing the cation Al, Ca, K, Na, Cu, Zn, Mg, Mn, Ba, Li can serve this purpose. Suitable anions can be carbonates, chlorides, nitrates, silicates, acetates, formiate, sulphates, phosphates and others.

The step of contacting the fibres or particles with the oxidant may be conducted under various conditions. It is generally advisable to mix the fibres or particles with the oxidant and the optional catalyst sufficiently to achieve proper contact between the reactants. The pH is suitably from about 1 to about 10, preferably from about 2 to about 5. The above pH range is obtained naturally with most oxidants and it is preferred not to add any other acid, particularly not strong acids such as mineral acids, before or during this step. The temperature is suitably from about 0 to about 200° C., preferably from about 20 to about 100° C. The time should be sufficient for water soluble reaction products with binding properties to form and preferably sufficient for substantially all the oxidant to react. The time required depends on the temperature, pH and amount and kind of oxidant and catalyst, but is in most cases suitably from about 0.5 to about 500 minutes, preferably from about 6 to about 200 minutes. Most preferably the time exceeds 15 minutes and particularly preferably it exceeds 20 minutes. Although traces of the oxidant may remain in some cases, this is generally less than about 10%, preferably less than about 3% of the amount charged. Should the pH of the final activated fibres or particles be too low, for example below about 3.5, cellulose might be hydrolysed. In such cases it would be preferred to adjust the pH by adding an alkaline substance before, after or simultaneously with the oxidant.

After the step of contacting the fibres or particles with the oxidant at least a significant part of the water soluble reaction products are retained with the fibres or particles, and consequently substantial amounts thereof should not be removed. This means that the treated fibres or particles should not be washed or leached with water or any aqueous medium, and if water is to removed, for example to improve the storage durability, this is preferably done by evaporation, for example in a drying step. Although some of the water soluble reaction products might be lost unintentionally, it is preferred that at least about 40%, more preferably at least about 50%, even more preferably at least about 70% and most preferably at least about 90% thereof are retained with the fibres or particles.

The presence of the water soluble reaction products gives the activated fibres or particles self binding properties. Hardening can be achieved under suitable condition, for example at a temperature from about 60 to about 300° C., preferably from about 120 to about 200° C. Compared to conventional formaldehyde based binding systems substantially equal or even better binding properties can be achieved. There are also considerable environmental advantages as it may be possible to decrease or even avoid emissions of formaldehyde or other volatile and/or toxic substances and also considerably decrease the formation of $NO_x$ when burning waste materials. The activated fibres or particles can be used in various applications, either alone or as a binder together with other fibrous materials. However, the most preferred use is in the production of press moulded or dry-formed products, then utilising the self-binding properties.

The product from the process can be further hardened by a heat treatment of the pressed object. The temperatures for the post treatment are suitably from 80-200° C. preferentially about 110-150° C. A suitable time for the post treatment is 3-1400 minutes preferentially 15-320 minutes.

Thus, the invention also concerns a process for the production of press moulded products comprising the steps of placing activated fibres or particles as described above in a press and then press moulding said activated fibres or particles for a time sufficient to achieve effective hardening.

The invention further concerns a press moulded product obtainable by such a process.

Any three-dimensional or plane press moulded product can be made, such as most kinds of board. Examples of particularly advantageous products include particle board, MDF (medium density fibre board), HDF (high density fibre board) OSB (oriented strand board), wafer board, and oriented wafer board. Provided the activated fibres or particles are in the form of veneer or the like, it is also possible to make plywood.

Preferably no substantial amounts of water soluble substances are removed from the press, and in order to achieve that the press is suitably designed not to allow escape of substantial amounts of a water in liquid form and preferably a closed press is used. Any properly designed press that is used in the production of board or other press moulded products with conventional binding systems can be used also in the process of the present invention. Although it may be hard to completely avoid that water escapes, the amount of water leaving the press in liquid state during press moulding is preferably less than about 30%, more preferably less than about 10%, most preferably less than about 5% of the total amount of water in press. However, there are no limitation in the amount of water leaving as vapour.

Before the press moulding the moisture content of the activated fibres or particles is preferably from about 5 to about 40 wt %, most preferably from about 10 to about 30 wt %. If the activated fibres or particles are too dry or too moist, it is preferred to include a step of bringing them to a moisture content within the above range before the press moulding. This is suitably done by removing water in a drying step, thus without removing substantial amounts of water-soluble substances, or by adding water.

In the preferred embodiment when substantially no oxidant from the production of the activated fibres or particles remain, this oxidant will not take substantial part in the hardening in the press.

The temperature at the press moulding is suitably from about 60 to about 300° C., preferably from about 120 to about 200° C. The pressure is suitably from about 0.5 to about 10 MPa, preferably from about 1 to about 5 MPa. The pressing time is suitably from about 0.5 to about 60 minutes, preferably from about 1 to about 30 minutes. It is also possible to vary the temperature and/or the pressure during the press cycle.

It is possible to use only one kind of activated fibres or particles of the same size order, or using different kinds of activated fibres or particles from different sources or within different size ranges. In the latter case the fibres or particles of the different kinds or size ranges can be put in different layers to optimise the properties of the final press moulded product.

As the activated fibres or particles generally already have sufficient binding properties, it is preferred not to add any further binder, particularly not binders based on formaldehyde, isocyanate or any other substance that may cause of toxic or unpleasant emissions.

Except for the binding system, the product of the invention can be produced by any conventional methods in any conventional press, preferably not allowing substantial amounts of water soluble substances to leave the fibres or particles.

Through the invention it is possible to produce press moulded product such as board of high strength and very low swelling in water, fully comparable with or even better than products made by conventional binding systems. By using high amounts of oxidant in the production of the activated fibres or particles it is also possible to make products of particularly high quality, having high density and extremely low swelling in water.

The invention will how be further illustrated through the following example which, however, not should be interpreted as limiting the scope of the invention. Unless otherwise stated, all percentages and parts refer to percent and parts by weight,

EXAMPLE 1

Experiments were made with saw-dust from spruce with the following particle diameter distribution: 15.4 wt % less than 0.25 mm; 74.1 wt % from 0.25 to 1 mm; 10.5 wt % from 1 to 2 mm. The sawdust had been dried in a conventional high temperature dryer and had a moisture content of about 7 wt %. In each experiment 107 g dry saw-dust was mixed with a 30 wt % aqueous hydrogen peroxide solution and a 30 wt % aqueous solution of $FeSO_4 \times 7H_2O$. After about 30 minutes treatment at room temperature the activated saw-dust was dried 4 hours at 60° C. and then stored in an desiccator until it was used for making samples of board.

The board samples were made by adding about 10-14 wt % water to the dry activated saw-dust, placing the moistened saw-dust in a closed 140×140×4.2 mm press and press moulding for 2 minutes at 170° C. and 2.55 MPa. When the material had cooled down, the board samples were taken out and conditioned at room temperature until the weight was constant (1-3 days). The internal bonding (IB) for each sample was determined in a tensile test measuring the force required for the board to break. The swelling for each sample was tested by cutting out a 50×50 mm piece putting it in a beaker with de-ionised water for 2 hours at 20° C. By measuring the thickness before and after the treatment with water, the degree of swelling in % was determined. In one experiment the above procedure was followed with fresh sawdust of birch, having a moisture content of about 50 wt %.

In another experiment also water-soluble tannins from bark was added. To verify the importance of water soluble reaction products formed during the treatment with the oxidant, experiments were also made in which the sawdust was leached with 500 ml water per 100 g saw-dust, either before or after the treatment.

For comparative purposes experiments were also made with only water and saw-dust, with only ferrous sulphate and sawdust, and with conventional urea/formaldehyde resin.

The results appear in the table below. If not otherwise stated dried sawdust from spruce was used. The percentages of the additives refer to wt % of dry sawdust.

TABLE 1

Treatment of the saw-dust before drying and pressing

| | IB ($kN/mm^2$) | Swelling (%) |
|---|---|---|
| 1% $FeSO_4$ + 2.8% $H_2O_2$ | 0.36 | 84 |
| 1% $FeSO_4$ + 5.9% $H_2O_2$ | 0.84 | 43 |
| 1% $FeSO_4$ + 8.8% $H_2O_2$ | 1.2 | 21 |
| 1% $FeSO_4$ + 18% $H_2O_2$ | 1.6 | 14 |
| 1% $FeSO_4$ + 18% $H_2O_2$ + 5% tannins from bark | 1.84 | 8 |
| Saw-dust from birch + 1% $FeSO_4$ + 8.8% $H_2O_2$ | 1.2 | not measured |
| 1% $FeSO_4$ + 18% $H_2O_2$ followed by leaching with water | 0.098 | 38 |
| Leaching with water, then 18% $H_2O_2$ + 1% $FeSO_4$ | 1.79 | 12 |
| 0.3% $FeSO_4$ + 18% $H_2O_2$ | not measured | indefinite |
| 18% $H_2O$ (i.e. no oxidation) | 0.01 | indefinite |
| 1% $FeSO_4$ (i.e. no oxidation) | 0.03 | indefinite |
| Pressing with 11% urea/formaldehyde resin | 1.43 | not measured |

It appears that when no oxidant is used for activation the particles the board is of very poor quality. The same applies to the board produced from saw-dust that have been leached with water after the activation with the oxidant, in contrast to the case when the saw-dust had been leached before the activation. It can also be concluded both the internal bonding and the swelling are improved with higher amount of oxidant and with the addition of tannins.

EXAMPLE 2

The following example is given to show the effect of ionic strength on the properties of the pressed product.

Two set of experiments were performed, the first when a salt, in this example $CaCl_2$, was dissolved in the oxidant solution. The experimental conditions except for the salt addition was essentially as in example 1 expect for the particle size of the sawdust. The sawdust in this experiment has following particle diameter distribution: 18.7 wt % less than 0.25 mm; 81.3 wt % from 0.25 to 1 mm. Adding the salts to the oxidised lignocellulosic material before pressing, performed the second set of experiments.

TABLE 2

The effect of ionic strength on swelling and strength properties

| | Swelling % | IB |
|---|---|---|
| No salt addition | 63 | 0.67 |
| 2% $CaCl_2$ added to the oxidation agent | 65 | 0.84 |
| 2% $CaCl_2$ added after oxidation | 55 | 0.69 |
| 5% $CaCl_2$ added to the oxidation agent | 35 | 0.83 |
| 5% $CaCl_2$ added after oxidation | 20 | 0.87 |
| 8% $CaCl_2$ added to the oxidation agent | 30 | 0.81 |
| 8% $CaCl_2$ added after oxidation* | 30 | 0.50 |

*The salt was added as a mixture of solid material and a solution $CaCl_2$ (aq).

EXAMPLE 3

This example is given to show the effect of a post treatment of a product made from the process describes in this application. The post treatment consists of treatment of a board manufactured by the aforementioned procedure. The post treatment consists of storage of the board at elevated temperatures. The sawdust was as described above for example two. The boards were manufactured as in Example 1.

TABLE 3

Post treatment of boards treated at 140° C. for different times

| Post treatment time, minutes | Swelling % | IB |
|---|---|---|
| 0 | 63 | 0.63 |
| 30 | 38 | 0.75 |
| 120 | 20 | 1.0 |

The invention claimed is:

1. A process for producing activated fibres or particles having self-binding properties comprising the steps of treating fibres or particles of lignocellulose containing material by contacting them with a radical generating oxidant for a time sufficient to form water soluble reaction products with binding properties and said activated fibers or particles, and retaining at least 40% of said water soluble reaction products with the activated fibres or particles wherein the fibres or particles of lignocellulose containing material are contacted with the oxidant for a time sufficient for substantially all the oxidant to react prior to press moulding or pressing of dry formed products.

2. The process as claimed in claim 1, wherein the fibres or particles of lignocellulose containing material are contacted with the oxidant during a time exceeding 15 minutes.

3. The process as claimed in claim 1, wherein the fibres or particles of lignocellulose containing material are contacted with the oxidant in the presence of a catalyst or initiator.

4. The process as claimed in claim 3, wherein the catalyst or initiator is selected from the group consisting of metal ions.

5. The process as claimed in claim 1, wherein one or more substances containing phenolic, quinonic or other aromatic groups is added before or during the step of contacting the fibres or particles with the oxidant.

6. The process as claimed in claim 5, wherein said one or more substances containing phenolic, quinonic or other aromatic groups is selected from the group consisting of tannins.

7. The process as claimed in claim 1, wherein salts are added to increase the ionic strength in the lignocellulosic material before a pressing step.

8. The process as claimed in claim 1, wherein the oxidant is selected from the group consisting of hydrogen peroxide and hydrogen peroxide generating compounds.

9. The process as claimed in claim 1, wherein the pH during the step of contacting fibres or particles of lignocellulose containing material with an oxidant is from about 2 to about 5.

10. The process as claimed in claim 1, wherein substantially no mineral acid is added before or during the step of contacting fibres or particles of lignocellulose containing material with an oxidant.

11. The process as claimed in claim 1, wherein the lignocellulose containing material is wood.

12. The process according to claim 1 further characterised in that the water soluble reaction products obtained are post treated at an elevated temperature.

13. The process as claimed in claim 12, wherein the process comprises a step of bringing the activated fibres or particles to have a moisture content from about 5 to about 30 wt % before a press moulding.

14. The process as claimed in claim 12, wherein the activated fibres or particles are press moulded in a closed press.

15. The process as claimed in claim 1, wherein at least 50% of said water soluble reaction products are retained.

16. The process as claimed in claim 1, wherein at least 70% of said water soluble reaction products are retained.

17. The process as claimed in claim 1, wherein at least 90% of said water soluble reaction products are retained.

18. A process for producing activated fibres or particles having self-binding properties, comprising:

treating fibres or particles of lignocellulose containing material by contacting said fibres or particles of lignocellulose containing material with a radical generating oxidant in the presence of a catalyst or initiator for a time sufficient to form water soluble reaction products with binding properties and said activated fibers or particles, and retaining at least 70% of said water soluble reaction products with the activated fibres or particles and wherein the fibres or particles of lignocellulose containing material are contacted with the oxidant for a time sufficient for substantially all the oxidant to react prior to press moulding or pressing of dry formed products.

* * * * *